US005546967A

United States Patent [19]

Weimer et al.

[11] Patent Number: 5,546,967

[45] Date of Patent: Aug. 20, 1996

[54] APPARATUS AND METHOD FOR WASHING BALLS

[75] Inventors: Ralph Weimer, Wheaton; Duane R. Acker, Mundelein, both of Ill.

[73] Assignee: Discovery Zone, Inc., Chicago, Ill.

[21] Appl. No.: 475,317

[22] Filed: Jun. 7, 1995

Related U.S. Application Data

[60] Division of Ser. No. 184,513, Jan. 21, 1994, Pat. No. 5,499,641, which is a continuation-in-part of Ser. No. 827, 773, Jan. 29, 1992, Pat. No. 5,353,822.

[51] Int. Cl.[6] ..... B08B 3/04

[52] U.S. Cl. ..... 134/65; 134/132; 134/133; 198/666

[58] Field of Search ..... 134/65, 69, 132, 134/133; 198/347.4, 661, 666; 15/21.2

[56] References Cited

U.S. PATENT DOCUMENTS

| | | | |
|---|---|---|---|
| 703,916 | 7/1902 | Haley . | |
| 790,834 | 5/1905 | Harvey . | |
| 937,970 | 10/1909 | Taplin . | |
| 2,005,115 | 6/1935 | Stutz . | |
| 2,089,102 | 8/1937 | Savage . | |
| 2,545,239 | 3/1951 | McQuiston, Jr. et al. | 134/65 |
| 2,548,996 | 4/1951 | Morton | 134/65 |
| 2,690,576 | 10/1954 | Dreesman . | |
| 2,760,504 | 8/1956 | Spurlin | 134/105 |
| 2,888,128 | 5/1959 | Allen | 198/666 |
| 3,038,186 | 6/1962 | Davy | 15/21.2 |
| 3,178,012 | 4/1965 | Weiss et al. | 198/666 |
| 3,382,046 | 5/1968 | Faugeras et al. | 131/65 X |
| 3,412,573 | 11/1968 | Pauliukonis | 134/65 |
| 3,498,839 | 3/1970 | Mehta | 134/65 X |
| 3,683,945 | 8/1972 | Weisser | 134/108 |
| 3,722,401 | 3/1973 | Davidson et al. | 99/407 |
| 3,834,408 | 9/1974 | Thalacker | 134/107 |
| 4,046,154 | 9/1977 | Tada et al. | 134/65 |
| 4,073,301 | 2/1978 | Mackinnon | 134/65 |
| 4,098,225 | 7/1978 | Norman | 134/65 |
| 4,106,705 | 8/1978 | Nakamura | 134/65 |
| 4,168,714 | 9/1979 | Bahrke | 134/65 |
| 4,217,917 | 8/1980 | Kilpainen . | |
| 4,258,069 | 3/1981 | Amstad | 426/483 |
| 4,354,514 | 10/1982 | Sundheimer et al. | 134/102.3 |
| 4,356,910 | 11/1982 | Togstad | 198/666 |
| 4,448,118 | 5/1984 | Kunz | 99/624 |
| 4,773,114 | 9/1988 | Thrasher | 15/21 |
| 4,782,843 | 11/1988 | Lapaglia | 134/200 |
| 4,852,719 | 8/1989 | Lapeyre | 198/666 |
| 4,958,720 | 9/1990 | Lapeyre et al. | 198/666 |
| 4,970,746 | 11/1990 | Brackman | 15/21.2 |
| 4,987,702 | 1/1991 | Anschutz | 51/164 |
| 5,020,555 | 1/1991 | Nishibayashi | 134/65 |
| 5,139,577 | 8/1992 | Brock | 134/254 |
| 5,165,432 | 11/1992 | McKibben | 134/65 |
| 5,353,822 | 10/1994 | Gutterman et al. | 134/65 |

FOREIGN PATENT DOCUMENTS

| | | | |
|---|---|---|---|
| 264462 | 4/1988 | European Pat. Off. . | |
| 1033143 | 7/1953 | France | 198/666 |
| 220504 | 4/1910 | Germany | 134/65 |
| 1295315 | 10/1965 | Germany | 134/360 |
| 581599 | 6/1958 | Italy | 134/65 |

(List continued on next page.)

*Primary Examiner*—Frankie L. Stinson
*Attorney, Agent, or Firm*—Pennie & Edmonds

[57] ABSTRACT

An apparatus for washing balls in a cleaning fluid includes a container for storing soiled balls, a cleaning unit for washing and rinsing the balls, and a clean ball hopper for storing washed balls. A soiled ball conveyor conveys the balls from the soiled ball hopper to the cleaning unit, while a pneumatic conveyor conveys clean balls from the cleaning unit to the clean ball hopper. A fluid supply system provides recirculated cleaning and rinsing fluids to the cleaning unit, and helps prevent the balls from becoming clogged in foam. The cleaning unit includes three vertical substantially transparent cylindrical housings. Upper and lower enclosures are opaque and remove from sight the top and bottom longitudinal axial ends of the cylindrical housings to provide an exciting visual effect as the balls are conveyed through the transparent elongated housings.

5 Claims, 13 Drawing Sheets

FOREIGN PATENT DOCUMENTS

| | | | |
|---|---|---|---|
| 614686 | 1/1961 | Italy | 134/65 |
| 43735 | 5/1964 | Japan | 134/132 |
| 192585 | 6/1967 | U.S.S.R. | 134/65 |
| 391824 | 7/1973 | U.S.S.R. | 134/65 |
| 576257 | 10/1977 | U.S.S.R. | 198/666 |
| 773144 | 10/1980 | U.S.S.R. | 134/65 |
| 1404538 | 6/1988 | U.S.S.R. | 134/105 |
| 1435511 | 11/1988 | U.S.S.R. | 198/666 |
| 1161209 | 8/1965 | United Kingdom | 134/105 |

20
RINSE
WASH
PREWASH
RINSE WATER TANK
WASH WATER TANK
B
B
B
164
100
38
74
180
34
90
182
36
102
166
110
172
76
30
210
214
216
190
173
88
184
162
158
170
191
178
212
160
176
188
32
174
156
186
168
154

RINSE WATER
WASH WATER
46
50
20
54
M
28
70b
70a
78
B
74
126
90
190
172
124
114
180
164
122
100
40
98
120
84
104
34
80
106
38
72
97
96
108
82
102
118
42
42
36
92
76
86
110
88
174
116
191
204
202
208
184
188
200
210
170
216
206
160
176
196
192
194
F
198

APPARATUS AND METHOD FOR WASHING BALLS

RELATED APPLICATION

This is a division of application Ser. No. 08/184,513 filed Jan. 21, 1994 now U.S. Pat. No. 5,499,641, which is a continuation-in-part of U.S. patent application Ser. No. 07/827,773 entitled Apparatus And Method For Washing Balls, filed Jan. 29, 1992 now U.S. Pat. No. 5,353,822, the disclosure of which is hereby incorporated by reference in its entirety.

FIELD OF THE INVENTION

The present invention relates to devices for washing balls. More particularly, the invention relates to devices for washing soft plastic balls commonly used for recreational purposes.

BACKGROUND OF THE INVENTION

Balls used for recreational purposes typically become soiled. For example, in the field of children's playground equipment, pits are filled with a large number of soft, plastic multicolored balls, each approximately three inches in diameter. Children and adults then roll and frolic in the ball-filled pits, thereby soiling the balls. For health and sanitation purposes, the balls are periodically cleaned. Sanitation is particularly important because balls in the ball pit are placed into direct contact with the faces and mouths of adults and children playing therein. Because of this contact, it is important that any chemicals that are used to clean the balls are thoroughly rinsed off.

A number of devices are known to automatically or semiautomatically clean balls. One system has a cylindrical housing in which an elongated screw conveyor is rotatably disposed. The conveyor carries balls from a ball inlet to a ball outlet, the ball inlet and outlet being located at opposite longitudinal ends of the housing.

While these devices are suitable, there exists a need for a ball washer which more thoroughly cleans and rinses balls. Such a device may operate near children playing in ball pits, and therefore should also have an operation which provides visual appeal and stimulation to children. Another consideration is that the balls used in ball pits are often crushed because they are hollow, soft plastic. Ideally, a ball washing device should separate crushed, defective or otherwise irregular balls from normal balls. At the same time, the ideal ball washing device should avoid crushing balls. The unit should be compact. Finally, because of the large number of balls which may require washing, it is desirable to provide ball containers for storing both dirty and clean balls. The apparatus should be semiautomatic so that a human operator is not required to continuously feed balls into the apparatus.

SUMMARY OF THE INVENTION

In accordance with the invention, an apparatus is provided for washing balls which has improved cleaning and rinsing action, and a visually stimulating operation. The apparatus is compact, and can be placed in an indoor playground without leaking washing fluid or exposing children to dangerous moving parts. It minimizes water use and pollution. It can wash soft, hollow plastic balls without crushing the balls.

In accordance with the invention, an apparatus for washing balls in a fluid is provided which includes three spaced apart elongated cylindrical housings. Preferably, the housings are substantially transparent and are generally vertically disposed (i.e., the longitudinal axis of each cylindrical housing is generally vertical). The apparatus is especially suited for washing hollow, soft plastic balls that are commonly used in children's indoor playground pits. The housings are suitable for holding the washing fluid, and include ball inlets and outlets at their respective longitudinal ends. The balls being washed enter the apparatus through the ball inlet of the first one of the cylindrical housings. A conveyor conveys the balls from the inlet to the outlet. Preferably, this conveyor is a screw coaxially disposed within the cylindrical housing. The screw can be fixed, in which case, the ball is propelled downwardly by gravity towards the ball outlet when the housing is generally vertically disposed or at least has a sufficient inclination from horizontal. Alternatively, the screw can be rotatable by motor or otherwise to drive the balls toward the ball outlet. This is particularly useful when the cylindrical housing is vertical and the balls must be driven upward toward a ball outlet that is vertically higher or above the ball inlet.

As the ball leaves the ball outlet of the first cylindrical housing, it is transferred via ramp, chute or other suitable means to the ball inlet of the second cylindrical housing. As in the first cylindrical housing, the balls are conveyed along the longitudinal extent of the second cylindrical housing toward the second cylindrical housing's ball outlet. From the second ball outlet, the balls are discharged from the apparatus.

To create a striking visual effect, an enclosure is disposed about the first ball outlet, second ball inlet and transfer means so that an observer viewing the ball washer cannot see the transfer of balls between the first and second cylindrical housings. The enclosure also prevents tampering with the movement of the balls.

In accordance with another aspect of the invention, the first cylindrical housing is substantially vertical and includes a ramp disposed within the housing to allow the balls to travel under the force of gravity to the second ball outlet. The ramp may be a zigzag configuration or a spiral screw. The second housing is also vertical and includes a motor driven screw conveyor for conveying the balls from the ball inlet at its lower end to the ball outlet at its upper end. A transfer chute connects the first housing's ball outlet with the second housing's ball inlet, and allows balls and fluid to travel under the force of gravity from the first housing to the second housing.

A fluid supply has two nozzles and discharges fluid into both the first elongated housing and the second elongated housing. A drain at the bottom of the second elongated housing collects the fluid accumulating within the second housing (and, by virtue of the transfer chute, fluid collecting in the first housing). Because the fluid contains soap, the driving action of the rotatable screw conveyor turns the fluid and causes a significant amount of foam to accumulate at the bottom of the second housing. This foam backs up the transfer chute. The balls, which are hollow and very light are buoyant in this foam, and will not travel down the transfer chute. To overcome this problem, the fluid is discharged from the first nozzle at a rate sufficient to propel the balls through the accumulated foam and into the second ball inlet.

In accordance with yet another aspect of the invention, the screw conveyor is formed of a plurality of sections along its longitudinal extent. Each section is mateably engagable with its adjacent sections to prohibit relative rotational movement between the sections. The overall screw conveyor assembly is slidably disposed within the elongated cylindrical housing. Each section includes a center conduit portion through which a line is placed. One terminal end of the line is anchored to the bottom-most section while the other terminal end of the line extends through the plurality of sections and emerges at the top-most section. A loop or handle is provided at the top-most end of the line for easy gripping.

When the screw conveyor must be removed for maintenance or the like, the operator simply pulls up on the line, sliding the assembly upward and out of the open-ended cylindrical housing. As each section is withdrawn from the housing, it can be tilted and slid off of the line for easy removal. This is particularly useful when a soiled ball hopper or other structural object is immediately above the ball washing apparatus. In such circumstances, it may be impossible to withdraw the screw conveyor as one continuous unit because insufficient room is provided. By using this sectional construction, the apparatus can be placed in smaller confines.

Alternatively, in place of a line which extends through the center conduit of each section, an elongated removal tool may be provided. The elongated tool selectively engages the upper portion of the sections so that they may be removed by a human operator. In one embodiment, the elongated tool has a threaded end. Each section has a plug disposed at the top portion of its central shaft. The plug includes a threaded well sized to receive the threaded end of the tool. To remove a section of the screw conveyor, the operator places the elongated tool into the cylindrical housing, and rotates the elongated tool to screw its threaded end into the well of the section's plug. With the tool thus engaged, the operator can lift the section to the top of the cylindrical housing, where the operator can grasp the section with his or her hand for removal.

In accordance with another aspect of the invention, three substantially vertical elongated cylindrical housings are disposed over a pan. The first vertical housing has a ball inlet near its upper end, a ball outlet near its lower end, and a screw conveyor disposed within the first housing to allow the balls to travel from the first ball inlet to the first ball outlet. The second housing has an inlet near its lower end, an outlet near its upper end, and a screw conveyor disposed within the housing to convey the balls from the inlet up to the outlet. A transfer chute is provided for transferring balls from the first housing's ball outlet to the second housing's ball inlet. The third cylindrical housing has an inlet near its upper end, an outlet near its lower end, and a screw conveyor coaxially disposed within the third housing to allow the balls to travel from the inlet to the outlet. A chute or ramp is provided for transferring the balls from the second housing's ball outlet to the third housing's ball inlet.

A fluid supply is provided for circulating a wash fluid to at least one of the elongated housings. The fluid supply includes a fluid tank and a drain at the bottom of that housing for collecting accumulated fluid. By using the recirculating fluid supply, the system can operate without being connected to an external fluid source (such as tap water). Tanks or the like can be provided to enable the unit to be operated in a stand-alone mode. By placing the unit over the pan, unacceptable leakage is prevented. In this manner, the unit can be located, for example, in the center of the children's play area. Any fluid leaking from the cylinder is collected by the pan. A drain line can also be connected to the bottom of the pan, if desired. Optional enclosures are used to cover the upper and lower ends of the vertical elongated cylinders to further reduce fluid leakage, and to prevent children or others from tampering with the operation of the unit or being exposed to dangerous moving parts or electrical outlets.

DETAILED DESCRIPTION OF THE PREFERRED EMBODIMENTS

1. Overall System

Figure 1:
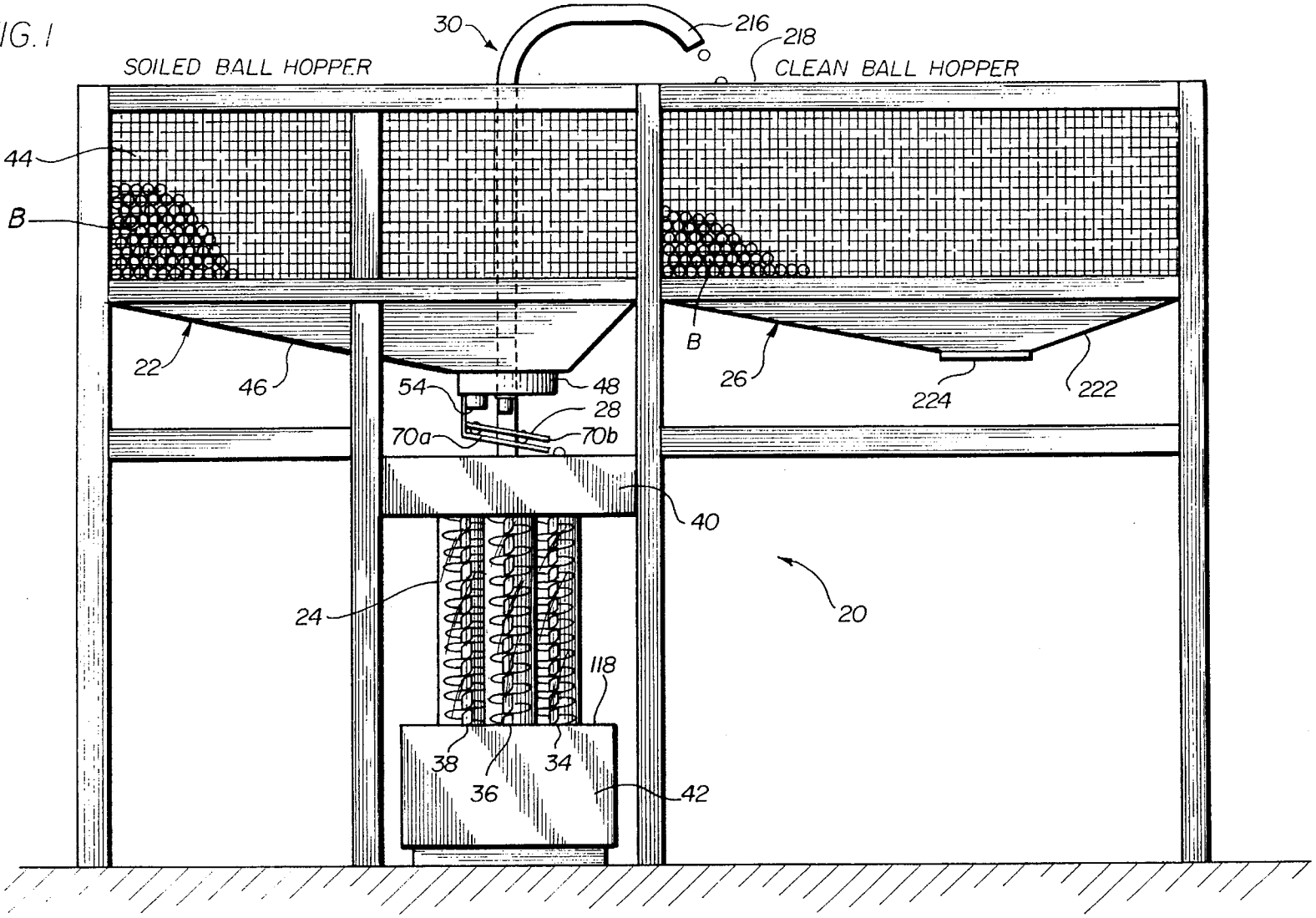
FIG. 1 is a front elevation of an apparatus for washing balls in accordance with the invention.

The preferred embodiments of the invention are shown in the drawings, where like reference numbers designate like components used in the several embodiments.

FIG. 1 illustrates an apparatus 20 for washing hollow, soft plastic balls B in a cleaning fluid. Apparatus 20 includes a container 22 for storing soiled balls B, a cleaning unit 24 for washing and rinsing the balls, and a clean ball hopper 26 for storing washed balls B. A soiled ball conveyor 28 conveys the balls from soiled ball hopper 22 to cleaning unit 24, while a pneumatic conveyor 30 conveys clean balls from cleaning unit 24 to clean ball hopper 26. A fluid supply system 32 (illustrated in FIG. 2) provides recirculated cleaning and rinsing fluids to cleaning unit 24.

Figure 2:
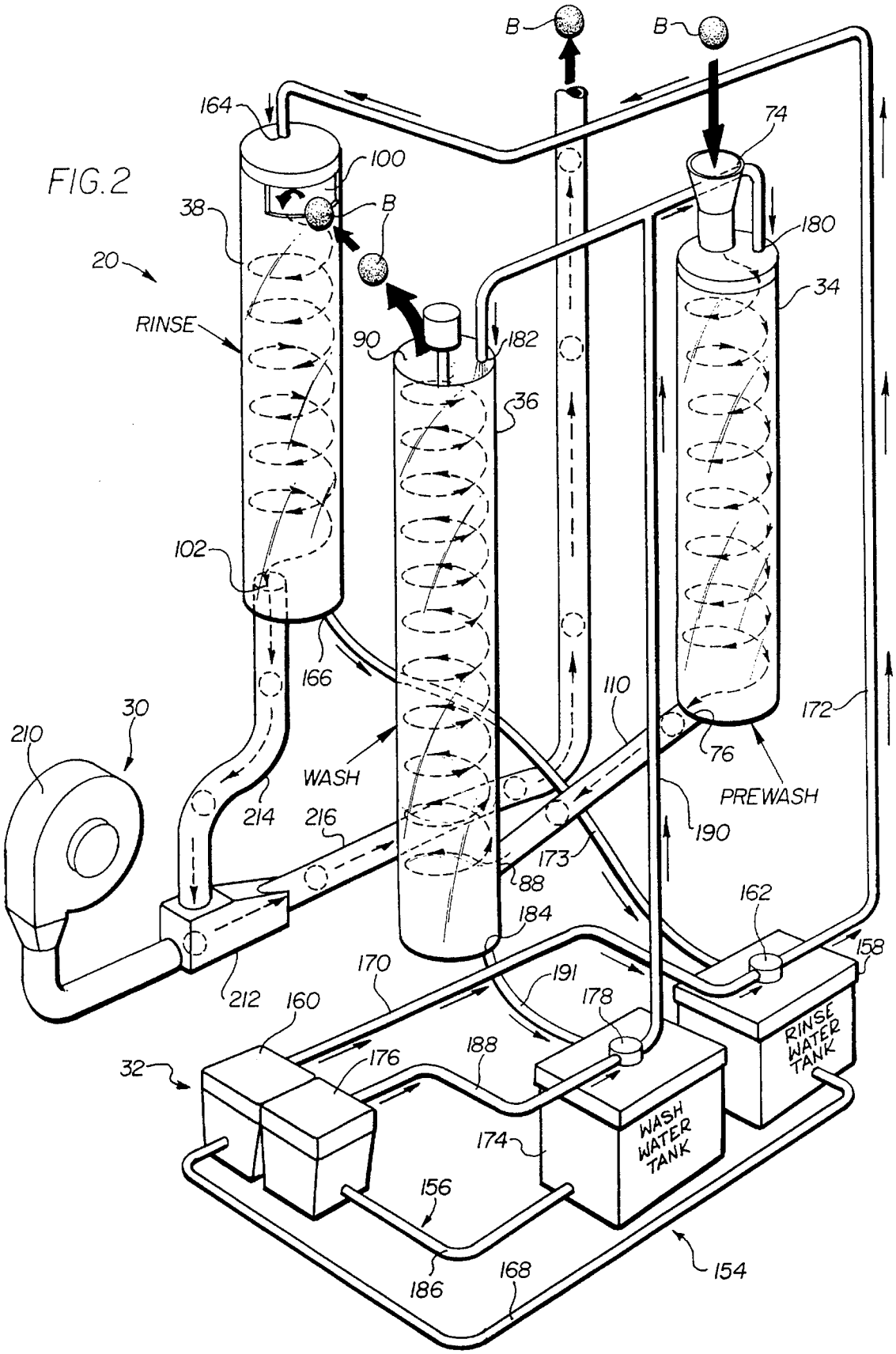
FIG. 2 is a schematic perspective view of the ball washing apparatus shown in FIG. 1.

As shown schematically in FIG. 2, the cleaning unit 24 includes three elongated cylindrical stages: a pre-wash stage 34, a wash stage 36 and a rinse stage 38. Balls entering the cleaning unit 24 move in series from the pre-wash stage 34 to the wash stage 36 and then finally to the rinse stage 38, from where they are conveyed by pneumatic conveyor 30 to clean ball hopper 26.

Figure 4:
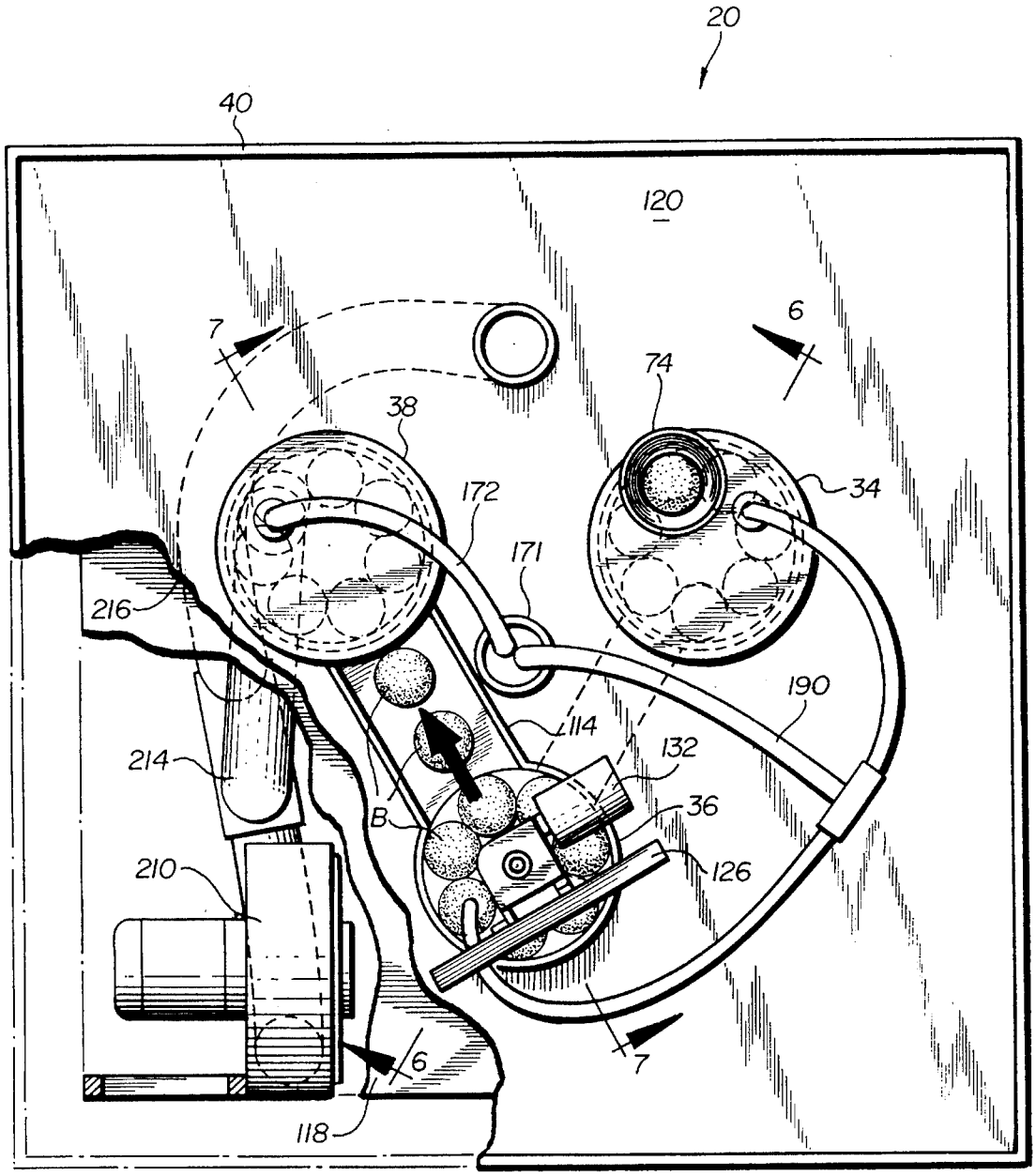
FIG. 4 is a cutaway top plan view of the apparatus shown in FIG. 1.

As best seen in FIGS. 1 and 4, stages 34, 36 and 38 are vertically oriented, and are placed in a delta configuration in close proximity and parallel to each other. Upper and lower enclosures 40 and 42 are opaque and remove from sight the top and bottom longitudinal ends of each of the stages 34, 36 and 38. In this manner, an observer only sees balls traversing the longitudinal extent of the elongated cylindrical stages, but cannot ascertain the source and origin of the balls B. This provides an exciting visual effect, particularly for children.

2. Soiled Ball Hopper

As best seen in FIG. 1, soiled ball hopper 22 includes a bin 44 for holding a large quantity of soiled balls. Soiled balls B may be loaded into bin 44 through an opening (not illustrated) at the top of the bin. An inclined bottom 46 leads the soiled balls B to a discharge port 48, where balls are discharged one at a time to the soiled ball conveyor 28. Balls roll down soiled ball conveyor 28, where they are deposited into prewash stage 34 (as schematically depicted in FIG. 2).

Figure 8:
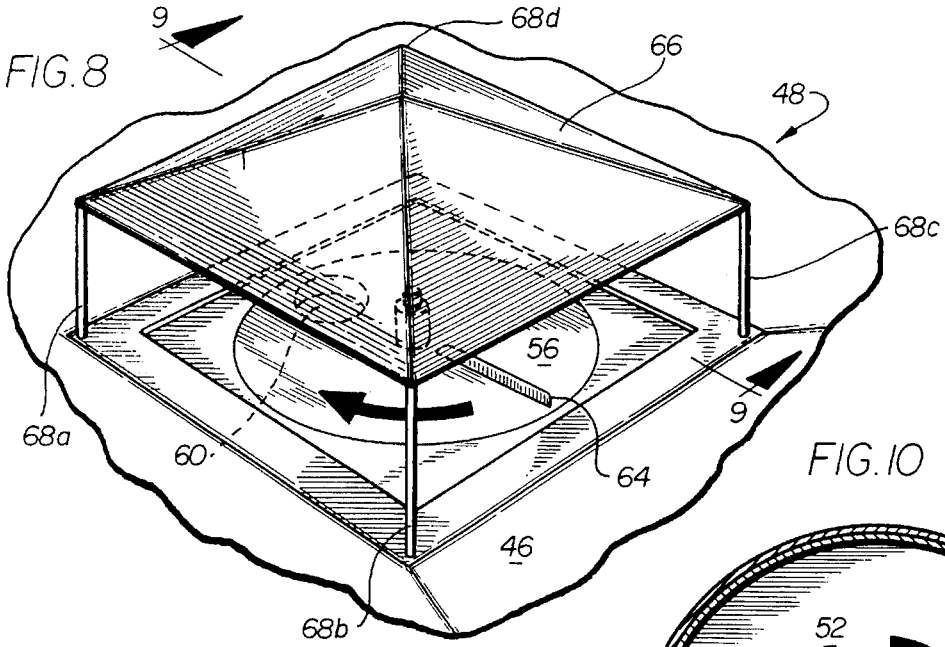
FIG. 8 is a perspective view of the ball discharge port of the soiled ball hopper apparatus shown in FIG. 1.
Figure 10:
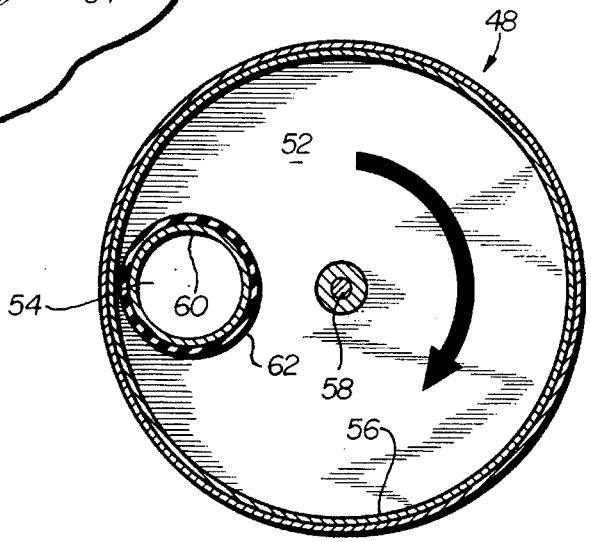
FIG. 10 is a sectional view of the discharge port shown in FIG. 8 and taken along the line 10—10 of FIG. 9.
Figure 9:
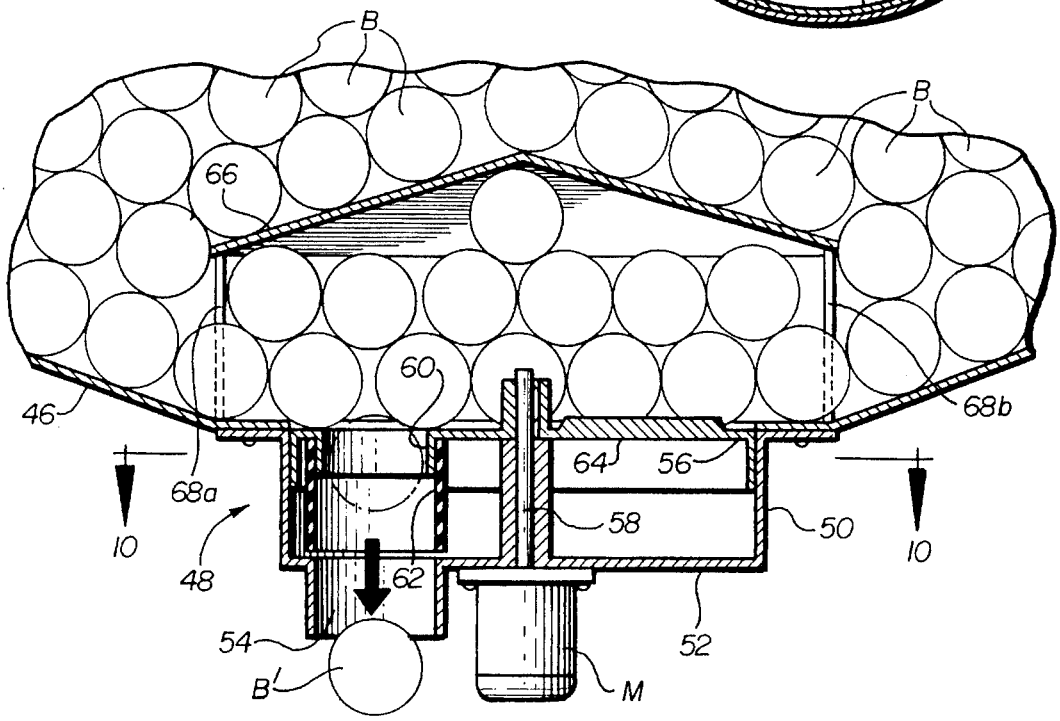
FIG. 9 is a sectional view of the discharge port shown in FIG. 8 taken along the line 9—9 of FIG. 8.

Discharge port 48 is shown in greater detail in FIGS. 8 through 10. Discharge port 48 features a cylindrical basin 50 having a flat bottom 52. Basin 50 is slightly deeper than the diameter of a ball B. Flat bottom 52 has a drop aperture 54 through which balls B may serially escape from soiled ball hopper 22. A rotatable carousel 56 is horizontally mounted for rotation on an axle 58, which is coaxially disposed within cylindrical basin 50. Axle 58 maintains carousel 56 in spaced parallel relation with flat 20 bottom 52 of basin 50.

Rotatable carousel 56, includes an aperture 60 near its perimeter. Aperture 60 is of a diameter slightly larger than one of balls B. A open-ended cylindrical cup 62 depends from aperture 60, and is sized to accommodate one ball B. As best seen in FIG. 9, balls accumulate on carousel 56, leaving one of the balls (such as ball B' in FIG. 9) free to fall through aperture 60 in carousel 56 into cup 62. A motor M drives carousel 56 in the clockwise direction (as viewed from above). As the carousel is rotated, cup 62 is brought into alignment with drop aperture-54 so that the ball B' occupying cup 62 may escape through drop aperture 54, as best seen in FIG. 9. By adjusting the speed at which motor M rotates carousel 56, the rate at which balls B are dispersed may be controlled. If the balls B are dispersed too quickly, they may jam the cleaning unit 24.

To prevent the balls B from jamming, carousel 56 includes a radially mounted scraper 64 on its upper surface (as best seen in FIG. 8). Scraper 64 is of rigid metal (or alternatively, plastic) and extends two centimeters from the surface of carousel 56. A pyramid shaped awning 66 is suspended at its four corners by vertical posts 68*a*–68*d*. Awning 66 bears the weight of the balls stored in bin 44 and prevents that weight from interfering with the operation of carousel 56. Balls such as balls B (shown in FIG. 9) are able to roll underneath pyramid awning 66 through the wide spaces between posts 68a-68d. Awning 66 also reduces the incidence of crushed balls.

Figure 3:
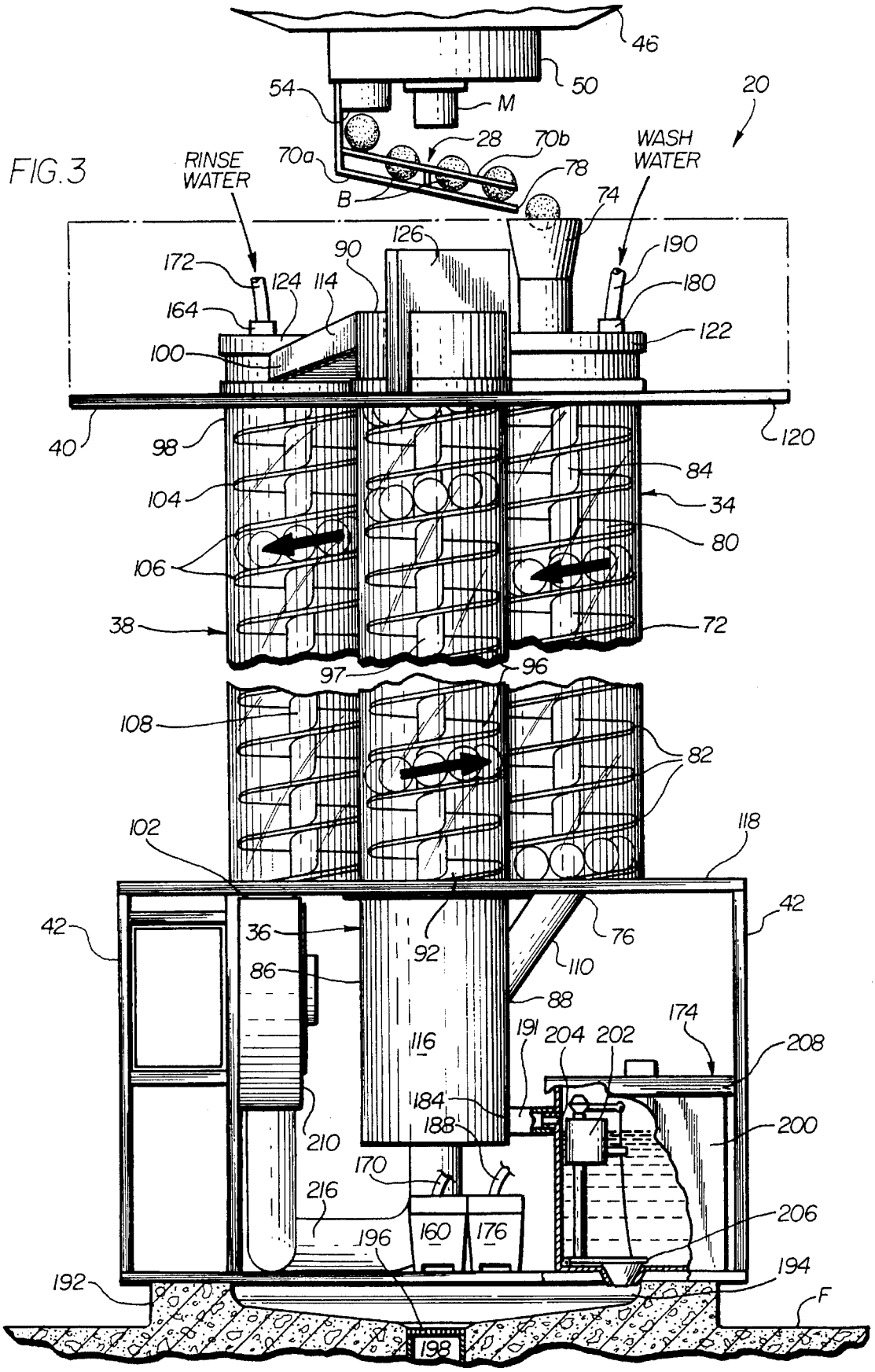
FIG. 3 is a partial front elevation of the washing apparatus shown in FIG. 1, in which portions of the apparatus have been removed to show the internal operation.

Referring to FIG. 1, the soiled ball conveyor 28 includes three inclined bars, (of which two, 70*a* and 70*b*, are visible in FIG. 3). The bars are arranged to an inverted delta configuration with the lowermost bar 70*a* horizontally centered between the upper two bars (including bar 70*b*) which are horizontally spaced somewhat greater than the diameter of balls B. Effectively, the bars 70*a*, 70*b* (and the third which is not shown) define a ramp with a V-shaped cross-section. Balls B are able to roll down the ramp from the discharge port 48 to pre-wash stage 34. It will be noted, that balls which are crushed or are otherwise irregularly shaped will be unable to negotiate conveyor 28 because they will be narrow enough in one dimension to fall between bars 70*a* and 70*b*, for example. In this manner the soiled ball conveyor 28 effectively prevents crushed or irregular balls from entering cleaning unit 24. The crushed or irregular balls which are thus separated can be periodically collected by a human operator.

Figures 4A, 4B:
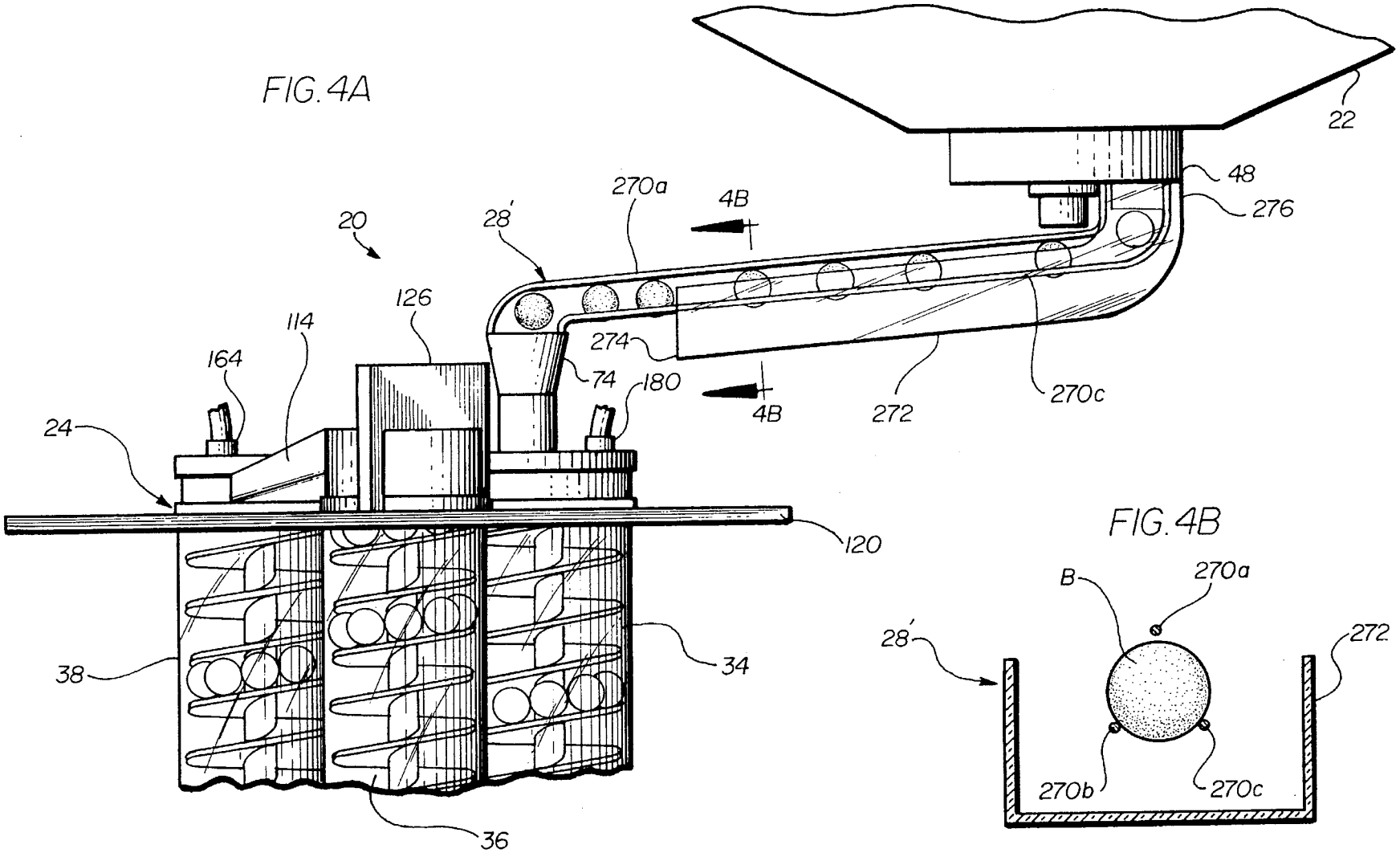
FIG. 4A is a partial side elevation of an alternative embodiment of the washing apparatus shown in FIG. 1, in which the upper enclosure has been removed to show the internal operation.
FIG. 4B is a sectional view of the apparatus of FIG. 4A taken along the lines 4B—4B.
Figure 4C:
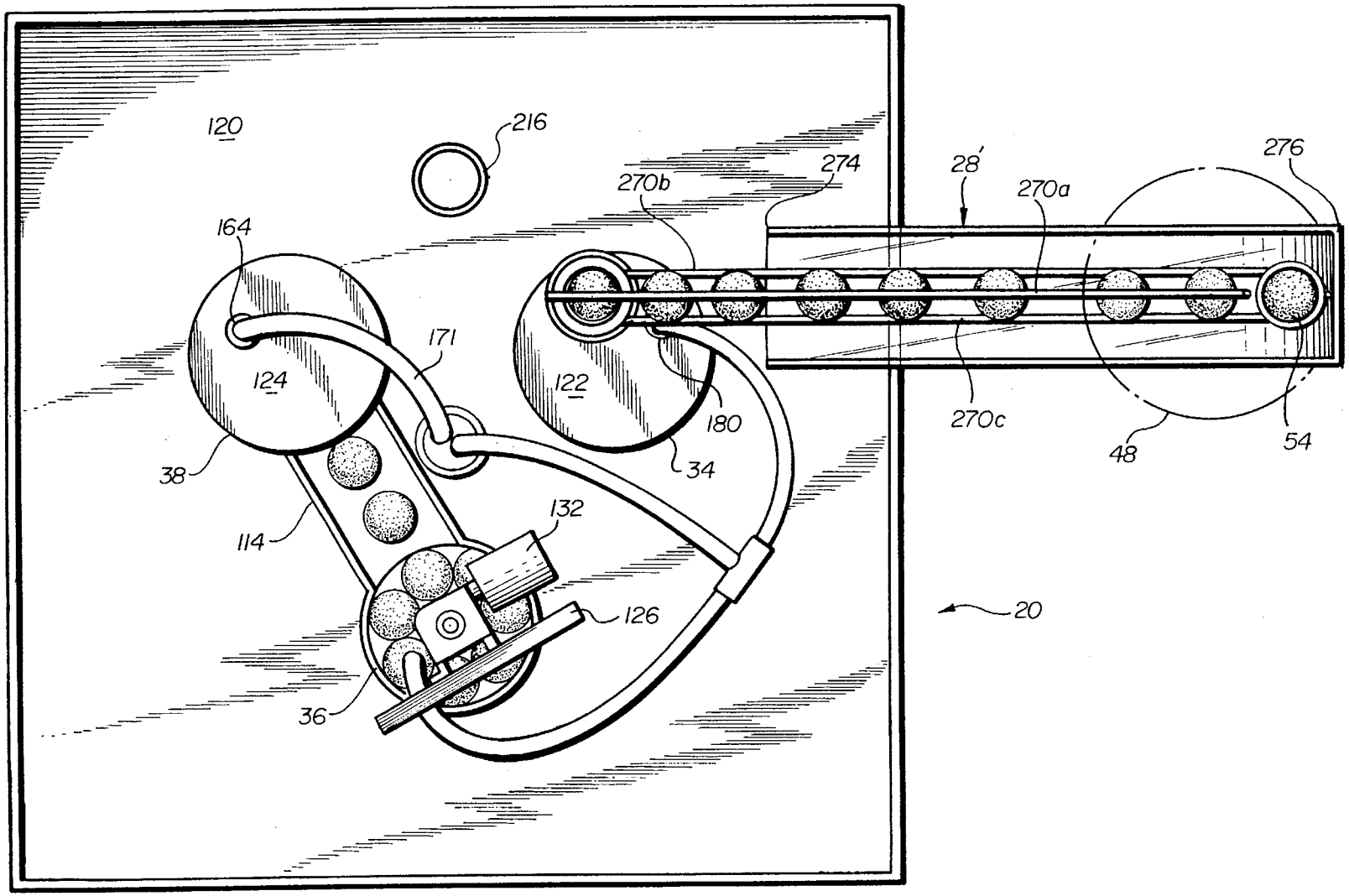
FIG. 4C is a top plan view of the apparatus shown in FIG. 4A, with the upper enclosure removed to show the internal operation.

Referring to FIGS. 4A through 4C, an alternative embodiment of the soiled ball conveyor 28' is illustrated. Soil ball conveyor 28' includes three inclined bars 270*a*, 270*b* and 270*c*. Except as otherwise indicated, the apparatus 20 of FIGS. 4A–4C is identical to the apparatus 20 of FIG. 1. The bars are arranged in a delta configuration, as best seen in FIG. 4B, with the uppermost bar 270*a* horizontally centered between the lower two bars 270*b* and 270*c*. The lower bars 270*b* and 270*c* are horizontally spaced somewhat less than the diameter of balls B. Effectively, the bars 270*a*, 270*b* and 270*c* define a ramp with an inverse "V"-shaped cross-section. As in the soiled ball conveyor 28, balls are able to roll down the ramp of soiled ball conveyor 28' from the discharge port 48 to prewash stage 34. Balls which are crushed or otherwise irregularly shaped will be unable to negotiate conveyor 28' because they will be narrow enough in one dimension to fall between the lower bars 270*b* and 270*c*.

In the illustration of FIGS. 4A and 4C, the soiled ball hopper 22 is not directly over the cleaning unit 24. As a result, an irregular or damaged ball traversing soiled ball conveyor 28' could fall between the bars 270*b* and 270*c*, and land on the floor (not shown) adjacent to the cleaning unit 24. In some cases, this may be undesirable, and therefore, a plastic trough 272 is optionally mounted to the soiled ball conveyor 28', as shown in FIGS. 4A, 4B and 4C. Elongated trough 272 is of clear plastic, and is at an incline. The lower end 274 of trough 272 terminates at a point above the cleaning unit 24, so that balls which fall into trough 274 and slide toward lower end 274 and are deposited on top of cleaning unit 24, where they can be collected by a human operator. The upper end 276 of trough 272 is curved upward to engage the discharge port 48 of the soil ball hopper 22.

3. Cleaning Unit

Figure 6:
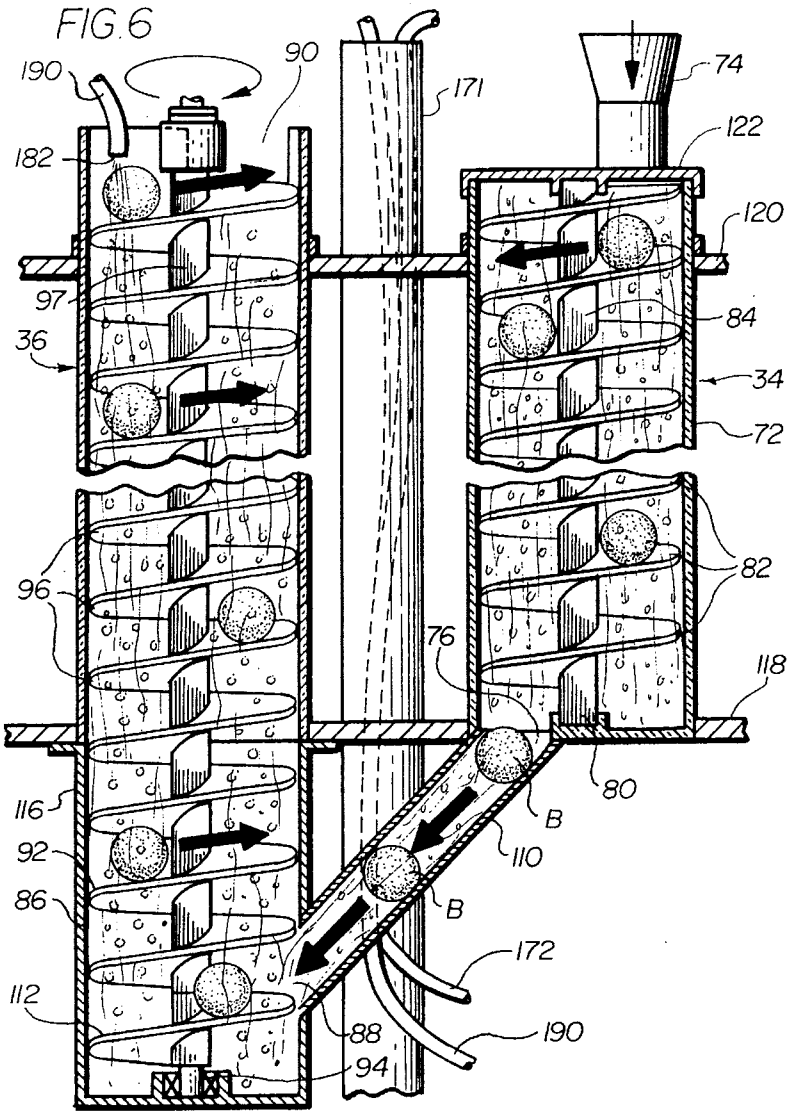
FIG. 6 is a partial sectional view of the wash and pre-wash stages shown in FIG. 2, taken along the lines 6—6 of FIG. 4.

Referring to FIGS. 2 and 3, each of the pre-wash, wash and rinse stages 34, 36 and 38 includes an elongated open-topped cylindrical housing with ball inlets and ball outlets located at the opposing longitudinal ends of the housing. Specifically, (as best seen in FIGS. 2, 3 and 6) pre-wash unit 34 includes a transparent cylindrical housing 72, funneled ball inlet 74 located near the upper end of housing 72, and ball outlet 76, located near the lower longitudinal end of housing 72. Pre-wash stage 34 is positioned so that funneled inlet 74 is under the terminus 78 of soiled ball conveyor 28. A fixed screw conveyor 80 is coaxially disposed within pre-wash stage 34. As best seen in FIG. 3, fixed screw conveyor 80 includes a plurality of flights 82, forming a spiral ramp about a central shaft 84. For clarity, not every flight of plurality 82 is designated by a reference number in the drawings. Flights 82 are spaced apart approximately one and one-half times the diameter of balls B to allow balls to travel serially under the force of gravity from pre-wash inlet 74 to outlet 76.

As best seen in FIGS. 2, 3, 6 and 7 wash stage 36 includes a cylindrical housing 86 which is transparent along most of its longitudinal extent. Wash stage 36 has a ball inlet 88 located near its lower longitudinal end, and a ball outlet 90 located at its upper longitudinal end. A rotatable screw conveyor 92 is coaxially disposed within the wash stage 36 on a journal bearing 94 (best seen in FIGS. 6 and 7). Screw conveyor 92 includes a plurality of spaced apart flights 96 forming a spiral path about a central shaft 97 which, when rotated, drive balls B upward toward wash outlet 90. Not every flight of plurality 96 is designated with a reference number in the drawings.

Figure 7:
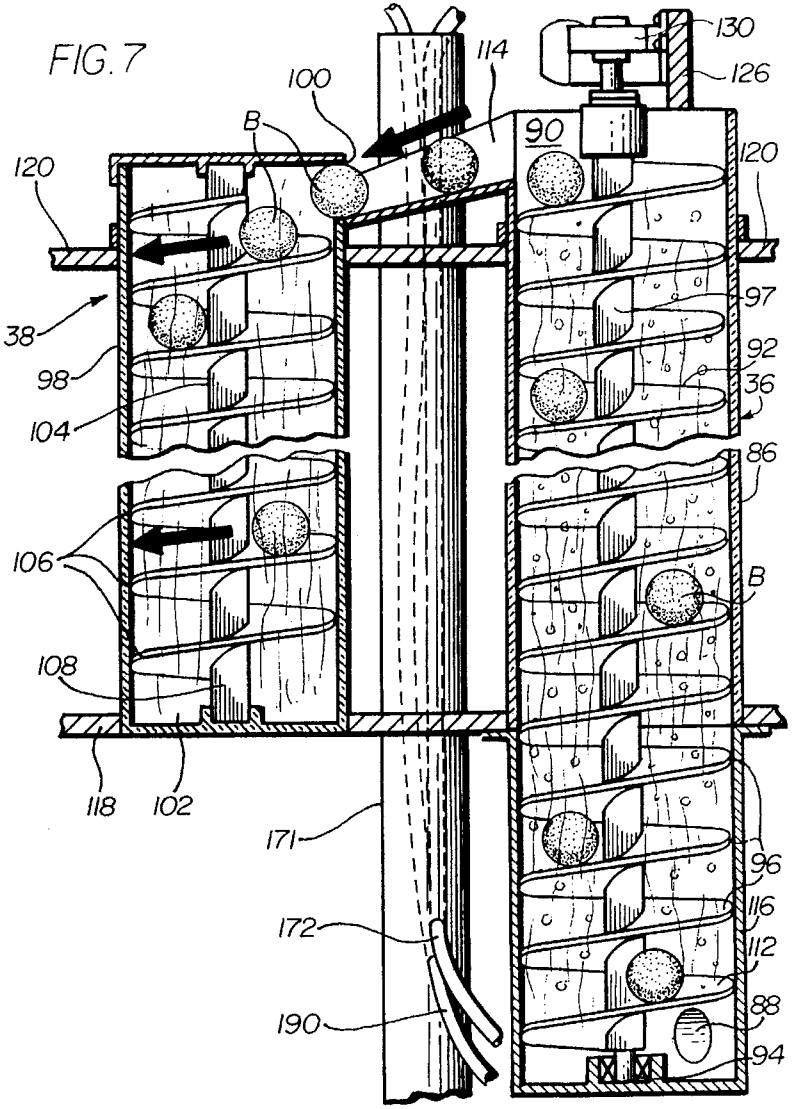
FIG. 7 is a partial sectional view of the wash and rinse stages shown in FIG. 2, taken along the lines 7–7 of FIG. 4.

As best seen in FIGS. 2, 3 and 7, rinse stage 38 includes a transparent cylindrical housing 98 having a ball inlet 100 located near its upper longitudinal end, and a ball outlet 102 located at its lower longitudinal end. Rinse stage 38 includes a fixed screw conveyor 104 having a plurality of flights 106 forming a spiral ramp about a central shaft 108. For clarity, not every flight of plurality 106 is designated by a reference numeral in the drawings. Flights 106 are spaced apart approximately one and one-half times the diameter of the balls B to allow balls B to travel serially under the force of gravity from rinse ball inlet 100 to rinse ball outlet 102.

While preferable, cylindrical housings 72, 86 and 98 need not be transparent. Moreover, by "transparent" it is meant that an external observer has visual access to the inside of the cylinders 72, 86 and 98. Thus, the cylindrical housings could, for example, be partially covered with decals or paint, and still be transparent for purposes of this invention. During operation of the apparatus 20, balls are sequentially dispensed from the soiled ball hopper 22 into pre-wash inlet 74.

As the balls enter pre-wash inlet 74, they travel under force of gravity along the spiral path defined by fixed screw 80 and emerge from pre-wash outlet 76, as best seen in FIGS. 2 and 6. An inclined transfer chute 110 allows balls and fluid to travel under the force of gravity from pre-wash outlet 76 to wash inlet 88. As balls enter wash stage 36, they roll onto the lowermost flight 112 of the rotating screw conveyor 92 (best seen in FIG. 6). To avoid crushing the balls, this lowermost flight 112 may be made of a pliable material such as rubber or neoprene plastic. The driving rotation of screw conveyor 92 conveys balls upward through wash stage 36 toward wash outlet 90.

Figure 5:
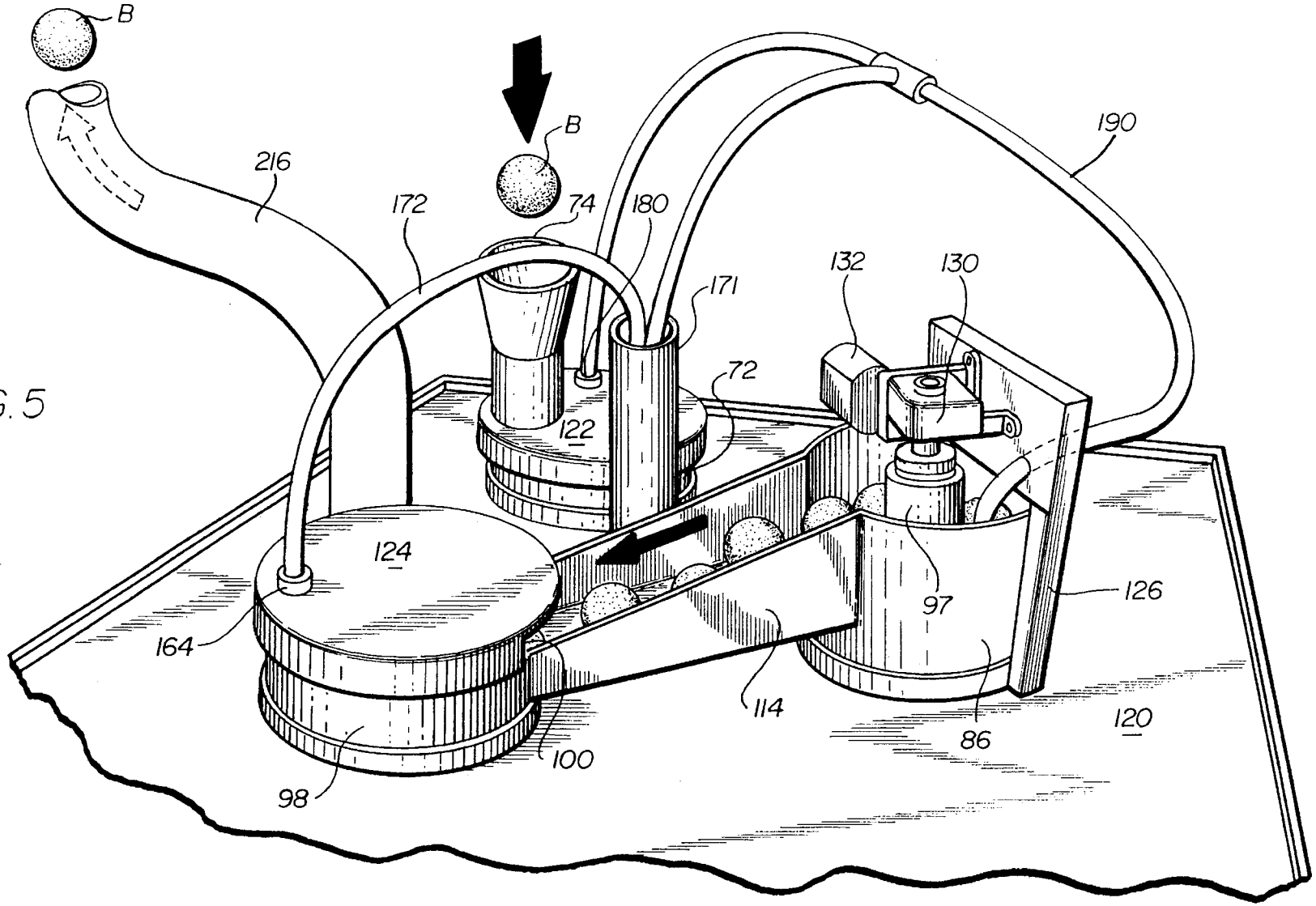
FIG. 5 is a enlarged perspective view of the top portion of the apparatus shown in FIG. 1 with the upper enclosure removed to show the internal operation.

As best seen in FIGS. 4, 5, and 7, as the balls B emerge from wash outlet 90, they are transferred via a transfer ramp 114 to ball inlet 100 of rinse stage 38. As the balls enter the rinse stage, they roll under force of gravity down the spiral path defined by the fixed rinse screw 104 and emerge from rinse stage 38 through rinse outlet 102. Balls emerging from rinse stage 38 are received by pneumatic conveyor 30 (discussed below in greater detail) and are conveyed to clean ball hopper 26 for storage.

As best seen in FIG. 1, cleaning unit 24 includes upper and lower box-like enclosures 40 and 42. The stages 34, 36, and 38 are vertically oriented and are placed in a delta configuration on top of lower enclosure 42. As shown in FIG. 3, a lower portion 116 of wash stage 36 extends below the top surface 118 of lower enclosure 42. Lower portion 116 is stainless steel. Wash stage 36 extends below pre-wash unit 38 to allow the transfer chute 110 between pre-wash stage 34 and wash stage 36 to be at an incline of approximately forty to forty-five degrees. Lower enclosure 42 serves the purpose of enclosing pneumatic conveyor 30 and fluid supply system 32 as shown in FIG. 2. In this manner, potentially dangerous electric and/or moving parts are not exposed. Lower enclosure 42 also encloses transfer chute 110.

Upper enclosure 40 encloses the upper ends of the pre-wash, wash and rinse stages 34, 36 and 38, including inlets 74 and 100 and outlet 90, as best seen in FIG. 3. Referring to FIG. 5, it will be noted that the upper longitudinal ends of cylindrical housings 72, 86 and 98 extend through the bottom 120 of upper enclosure 40, so that they are enclosed by upper enclosure 40. Pre-wash stage 34 and rinse stage 38 have removable lids 122 and 124, respectively, which cover their open tops. Lids 122 and 124 include apertures for accommodating fluid lines, as discussed below in greater detail. Lid 122 also includes an aperture (not shown) for accommodating the pre-wash ball inlet 74. Cylindrical housing 86 of wash stage 36 does not include a lid, as the balls B are driven out its open-ended top by the driving action of screw conveyor 92. A mounting bracket 126 is suitably affixed to the bottom 120 of upper enclosure 40, and mounts a gear box 130 which receives central shaft 97 in journal fashion. A motor 132 is operatively coupled to gear box 130 to drive central shaft 97.

In this manner, the upper and lower enclosures 40 and 42 leave exposed only the central portions of elongated cylindrical housings 72, 86, and 98. To an observer (such as a child) looking upon cleaning unit 24 from the advantage point of FIG. 1, a striking visual impression is realized. Specifically, the observer sees balls moving along the longitudinal extent of cylinder housings 72, 86 and 98. However, because the transfer chute 110 and ramp 114 are not visible, it is not apparent as to the precise origin of the balls seen traversing the elongated cylindrical housings. An illusion is created as the balls are coming from an unseen source.

Figure 11:
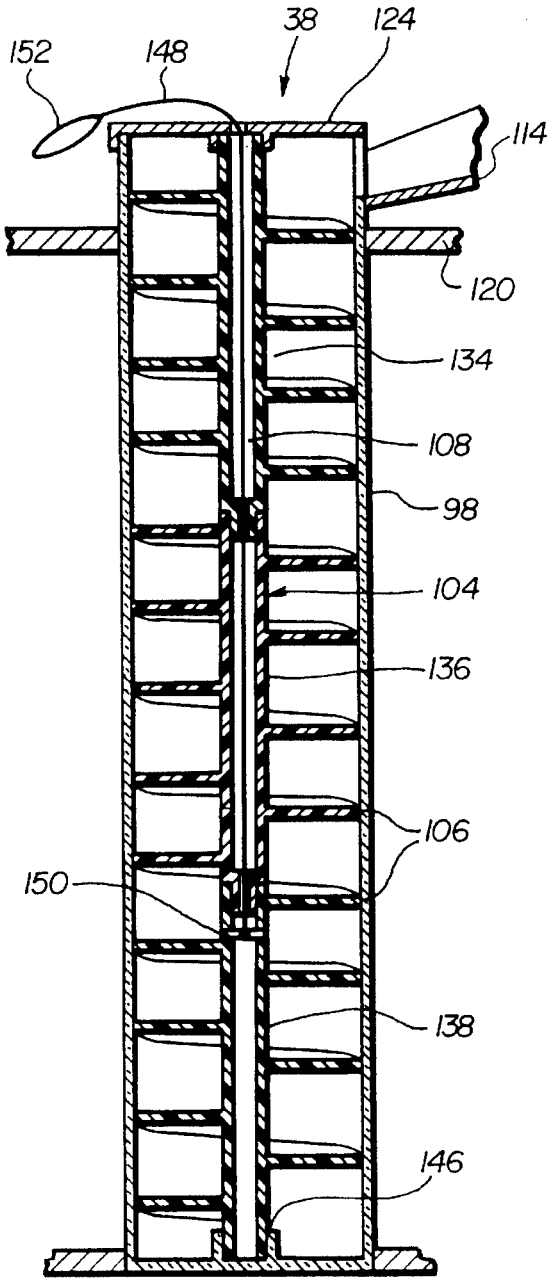
FIG. 11 is a sectional view of the rinse stage shown FIG. 3 showing a screw conveyor having three sections in accordance with one embodiment of the invention.
Figure 12:
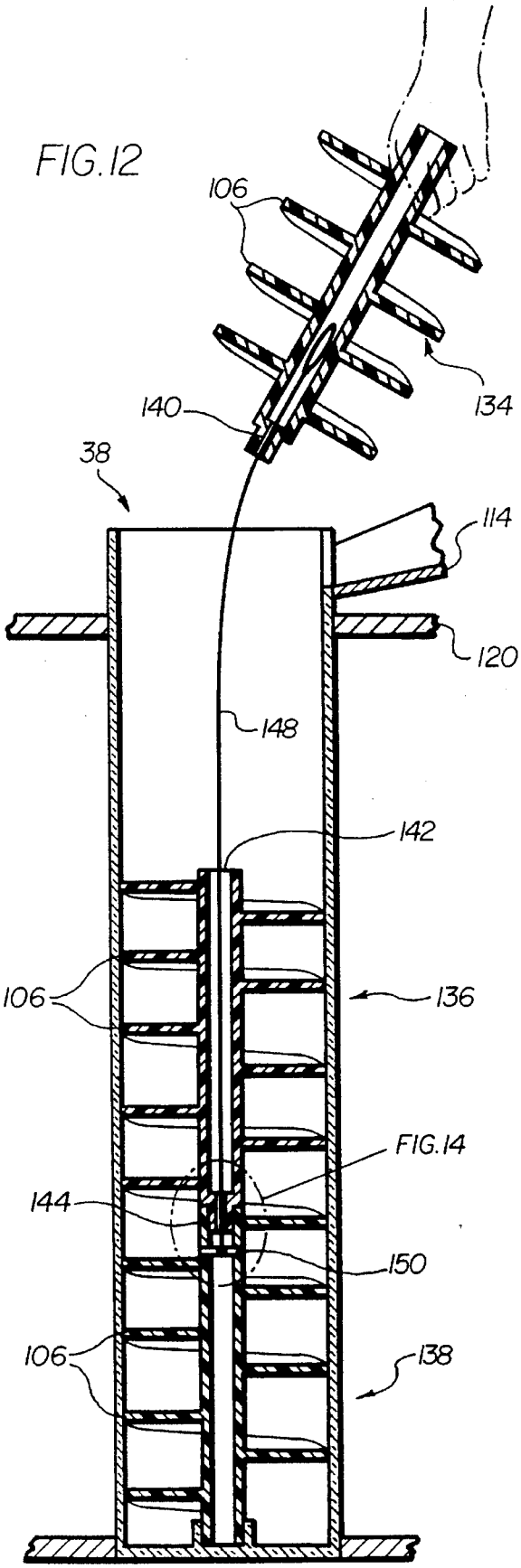
FIG. 12 is a sectional view of the rinse stage of FIG. 11 showing the removal of one section of the screw conveyor.

Because cylindrical housing 98 is open-ended, screw conveyor 104 can be withdrawn from cylindrical housing 98. To facilitate the withdrawal of screw conveyor 104, a special sectional construction is utilized. Specifically, as shown in FIGS. 11 and 12, the screw conveyor 104 comprised of three sections 134,136 and 138 along its longitudinal extent. The top-most section 134 is mateably joined to the midsection 136 by a hollow square peg 140 which depends from the bottom of section 134. Square peg 140 is received by a mating square socket 142 formed in the upper portion of section 136. In this manner, the sections 134 and 136 cannot have relative rotational movement. Likewise, the middle section 136 is joined to the bottom section 138 by a similar square peg and socket assembly 144. The bottom of central shaft 108 is received by socket 146.

Figure 13:
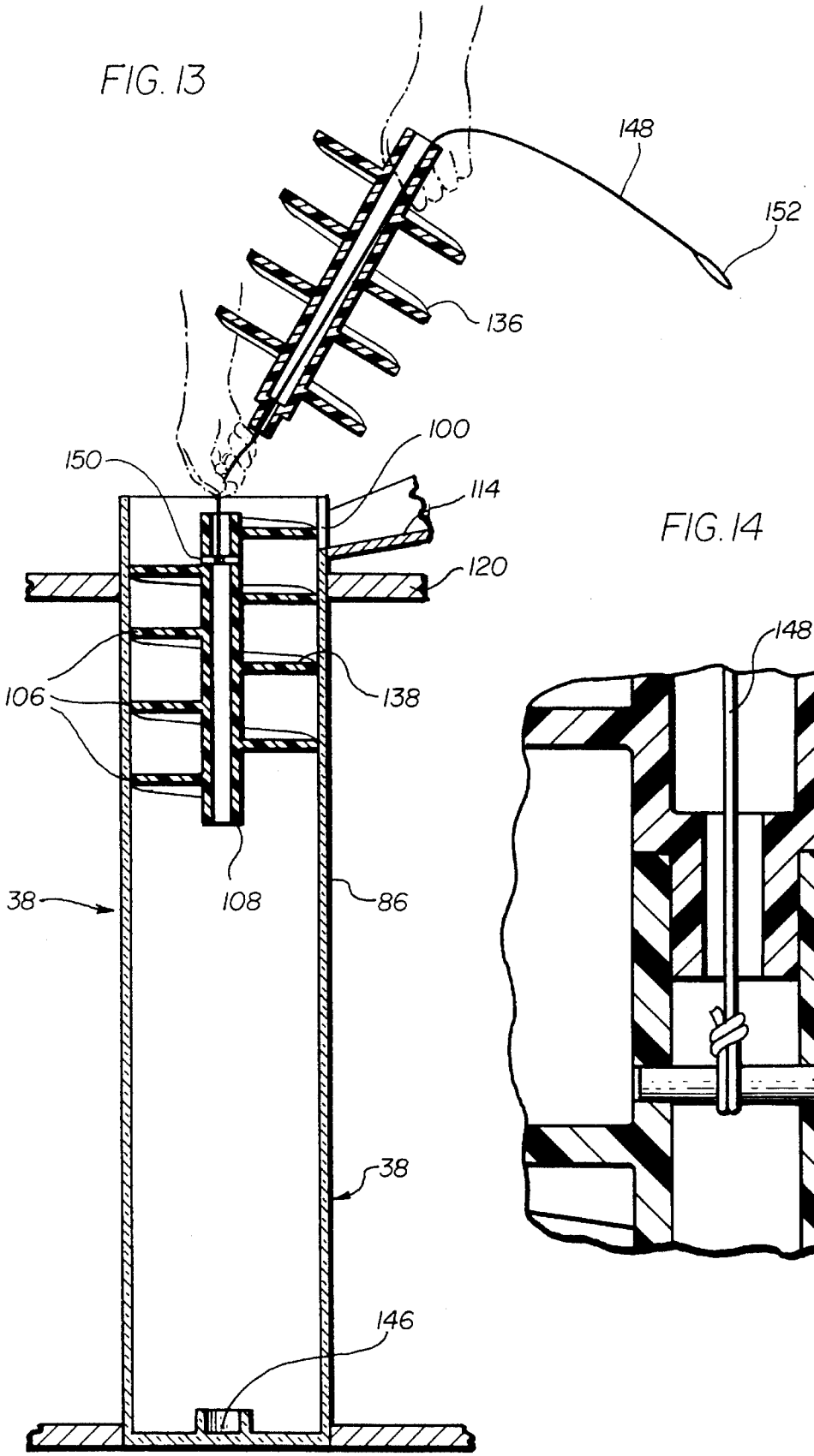
FIG. 13 is a sectional view of the rinse stage of FIG. 11 showing the removal of a second section of the screw conveyor.
Figure 14:
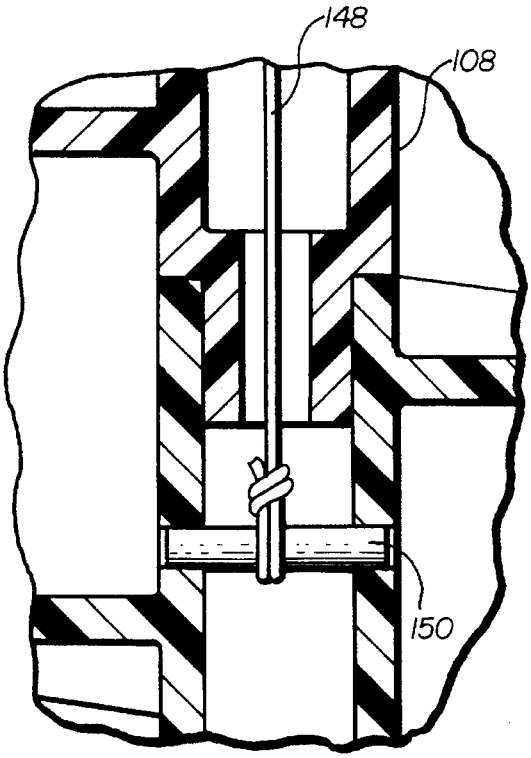
FIG. 14 is an enlarged sectional view of the rinse stage of FIG. 11.

It will be seen from FIGS. 12 and 13 that the screw conveyor 104 is slidably disposed within elongated cylindrical housing 98 for easy removal therefrom. Central shaft 108 is hollow to accommodate a line or cord 148. The lower end of line 148 is anchored to lower-most section 138 by an anchor assembly 150 as shown in FIG. 14. Line 148 is then threaded through the hollow central socket 146 of midsection 136 and the hollow central section of top-most section 134. The upper-most end of line 148 includes a loop or handle 152 which may be easily grasped by the maintenance operator. Line 148 is of a length sufficient such that loop or handle 152 extends at least somewhat beyond the top-most section 134 when all three sections are installed.

The sectional construction described above with respect to screw conveyor 104 is also employed with screw conveyors 80 and 92. Use of sectional construction allows for a more compact apparatus 20 because less clearance is required between tops of cylindrical housings 72, 86 and 98 and soiled ball hopper 22, for example.

Figure 15:
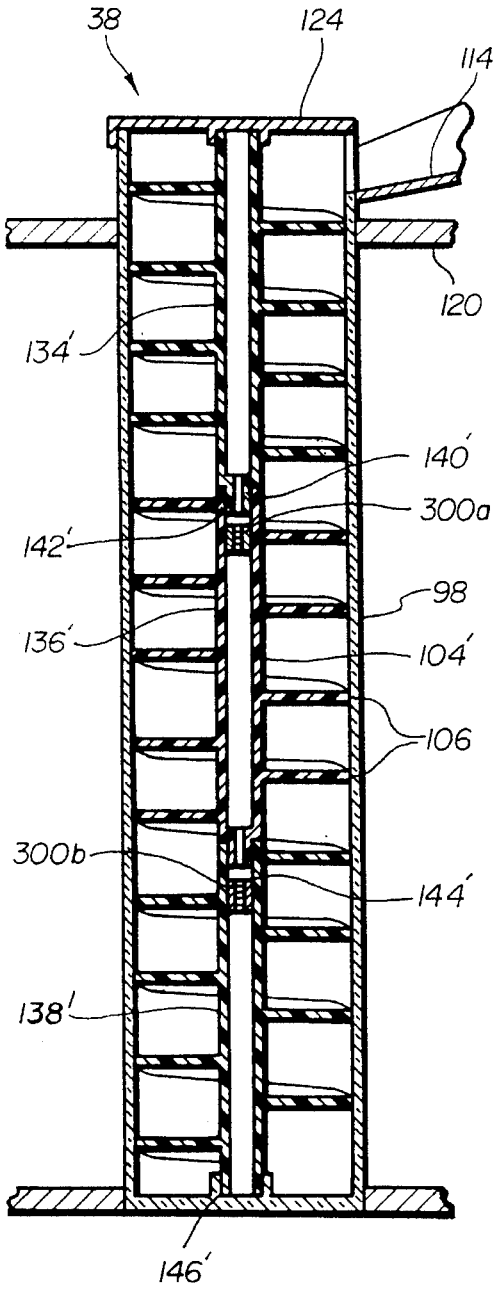
FIG. 15 is a sectional view of the rinse stage of FIG. 3 showing a screw conveyor having three sections in accordance with a second embodiment of the invention.
Figure 18:
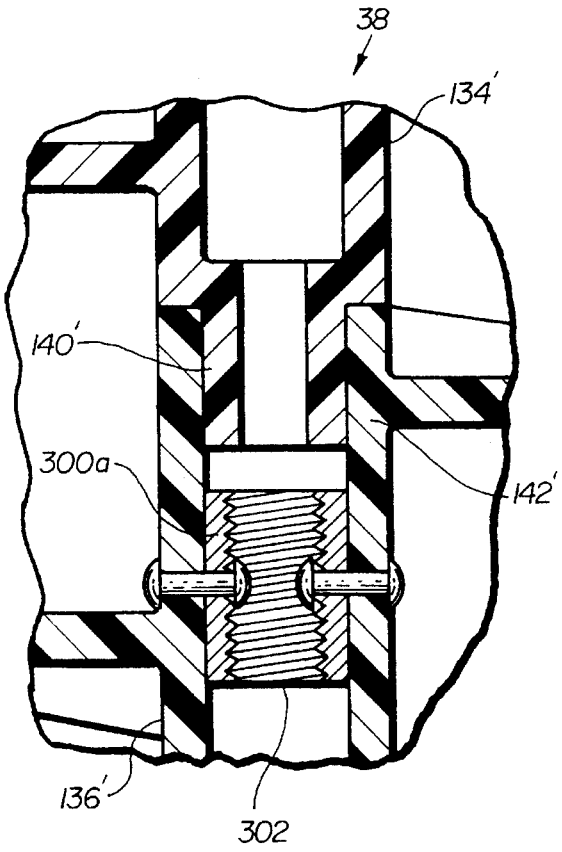
FIG. 18 is an enlarged sectional view of the rinse stage of FIG. 14.

An alternative means for removing a sectional screw conveyor is shown in FIG. 15. Screw conveyor 104' is comprised of three sections 134', 136' and 138' along its longitudinal extent. The topmost section 134' is mateably joined to the midsection 136' by a hollow square-peg 140' which depends from the bottom of section 134', as best seen in the enlarged view of FIG. 18. Square peg 140' is received by a mating square socket 142' formed in the upper portion of section 136'. In this manner, the sections 134' and 136' are unable to have relative rotational movement. A threaded plug **300*a* is inserted into square socket 142. Plug 300*a* includes a threaded aperture 302, the function of which is described below. Likewise the middle section 136' is joined to the bottom section 138' by a similar square peg and socket assembly 144'. The bottom of central shaft 108' is received by socket 146'**.

In place of a line or cord 148 an elongated tool 304 is provided for removing the mid and lower sections 136' and 138'. The elongated tool has a threaded end 306 which is sized for screwing insertion into the aperture 302 of plug **300*a*. A bristle head assembly (not shown) can also be attached to threaded end 306 so that tool 304 can be used to clean the inside of cylindrical housings 72, 86 and 98**.

Figure 16:
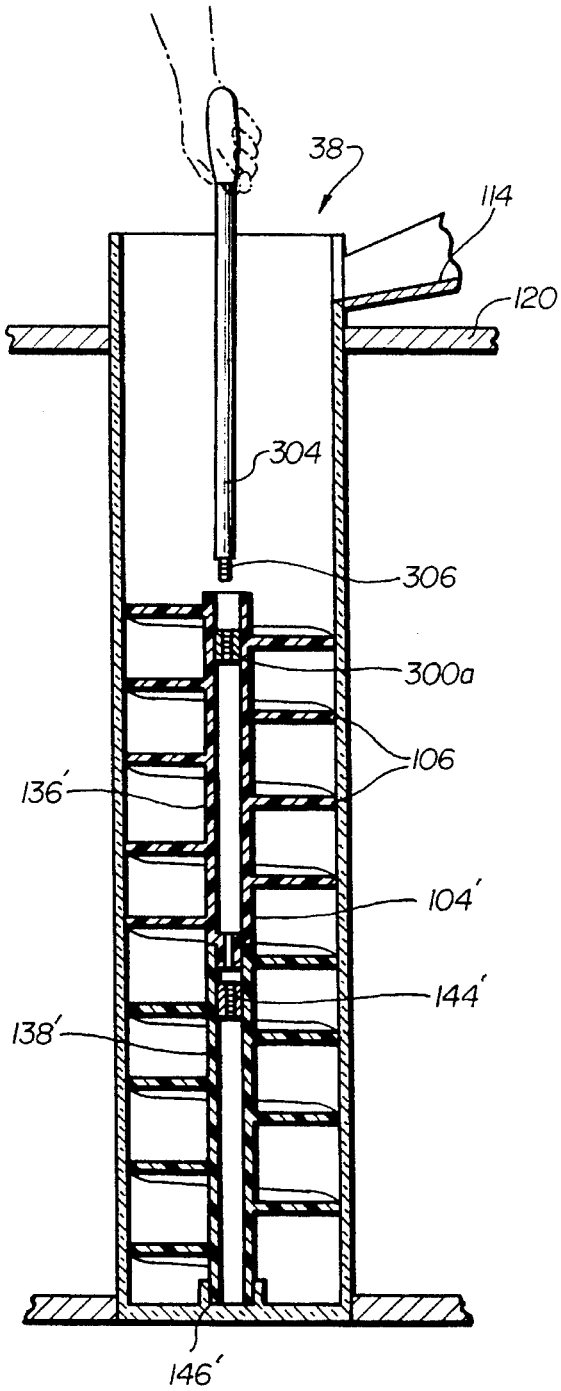
FIG. 16 is a sectional view of the rinse stage of FIG. 15 showing removal of one section of the screw conveyor.
Figure 17:
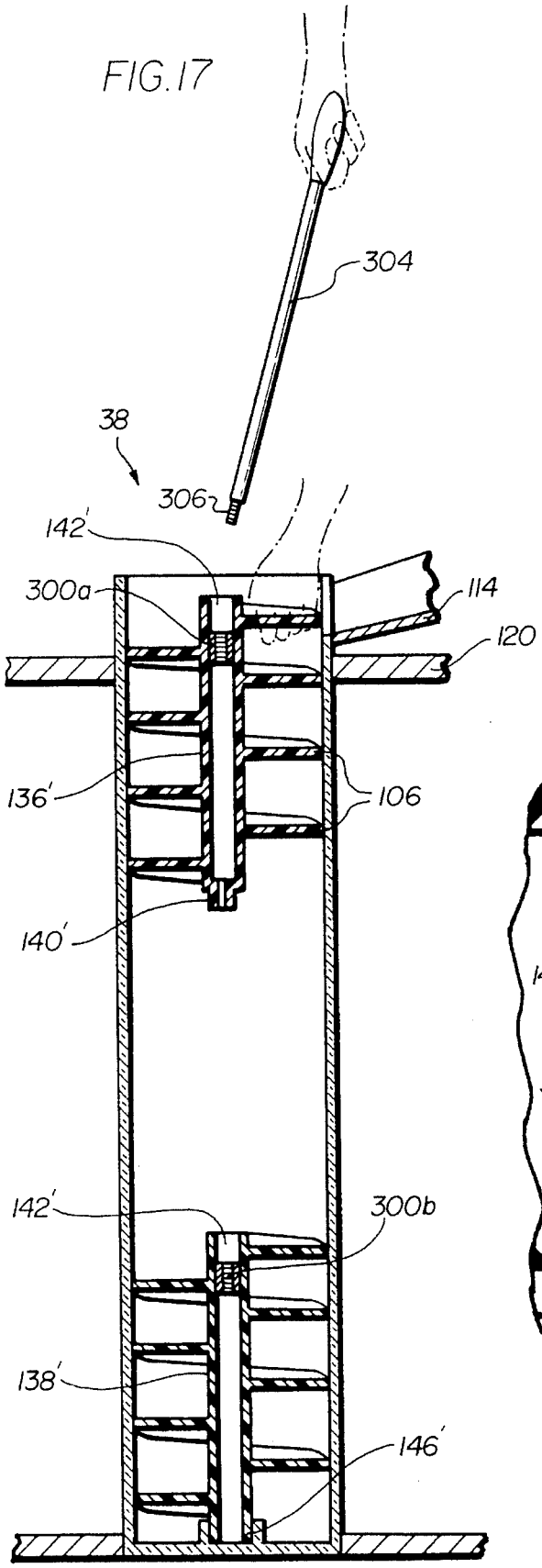
FIG. 17 is a sectional view of the rinse stage of FIG. 15 showing removal of a second section of the screw conveyor.

To remove sectional screw conveyor 104, a human operator removes lid 124, and grasps the topmost section 134', which the human operator can then lift out of the cylindrical housing 98. Then, as shown in FIG. 16, the human operator extends elongated tool 304 into the cylindrical housing 98 and inserts threaded end 306 of elongated tool 304 into threaded aperture 302 of plug **300*a*. The human operator then rotates the elongated tool 304 to securely engage threaded end 306 into the threaded aperture 302. With tool 304 thus engaged to the midsection 136', the human operator can lift midsection 136' to the upper portion of cylindrical housing 98. There, the human operator can grasp the midsection 136' for removal, as shown in FIG. 17. In the same manner, the elongated tool 304 can be used to engage plug 300*b* of the bottom section 138'** for removal.

4. Fluid Supply System

Fluid supply system 32 provides rinsing and washing fluid to the apparatus 20, and is best seen in FIGS. 2 and 3. The system includes a rinse fluid subsystem 154 and a wash fluid subsystem 156. Preferably, the rinse fluid is a softened water and the wash fluid is a soft water and detergent mixture. Other suitable fluids may be used. By recirculating the wash and rinse fluid, the apparatus 20 conserves fluid (notably, water) and does not require a constant source of fluid.

The rinse fluid subsystem 154 is comprised of a rinse fluid tank 158, a rinse fluid pump 160, a strainer 162, a nozzle 164 disposed in the upper end of the rinse stage 38, and a drain 166 disposed at the lower end of rinse stage 38. During operation of apparatus 20, rinse fluid is continuously cycled from the rinse fluid tank 158 to pump 160 (via a line 168), then from pump 160 to strainer 162 (via a line 170), and finally from strainer 162 to nozzle 164 (via a line 172). A vertical conduit 171 is provided for enclosing line 172. As best seen in FIGS. 2 and 7, rinse fluid discharged from nozzle 164 cascades down flights of rinse screw 104. As the rinse fluid accumulates in the lower end of rinse stage 38, it is collected by drain 166 and returned to rinse fluid tank 158 (via a line 173).

Wash fluid subsystem 156 is comprised of a wash fluid tank 174, a pump 176, a strainer 178, two nozzles 180 and 182, and a drain 184. Nozzle 180 is disposed at the top of pre-wash stage 34, and nozzle 182 is disposed at the top of wash stage 36. Drain 184 is disposed at the bottom of wash stage 36, but alternatively could incorporate a second drain (not shown) disposed at the bottom of pre-wash unit 34. During operation of apparatus 20, wash fluid is cycled continuously from wash fluid tank 174 to pump 176 (via a line 186) then to the strainer 178 (via a line 188) then to nozzles 180 and 182 (via a line 190). Line 190 is run through vertical conduit 171. The fluid is discharged from the nozzles 180, 182 where it enters the pre-wash and wash stages 34 and 36, respectively. Strainers 162 and 178 permit recirculation by removing lint and other debris, and must be periodically removed and cleaned.

As best seen in FIGS. 2, 3 and 6, fluid discharged from nozzle 180 cascades down the spiral flights of fixed screw conveyor 80 and accumulates at the bottom of pre-wash stage 34. Likewise, fluid discharged from nozzle 182 cascades down flights of rotatable screw conveyor 92, and accumulates at the bottom of wash cylinder 86. As depicted in FIG. 6, the fluid accumulating in pre-wash stage 34 flows through transfer chute 110 into the cylindrical housing 86 of wash stage 36. Thus, drain 184 serves as a drain for both pre-wash and wash stages. Wash fluid is taken up from drain 184 back to wash fluid tank 174 by a line 191.

Referring to FIG. 5, nozzles 164 and 180 are shown extending through lids 124 and 122, respectively. Placement of the nozzles through the lids 122 and 124 provide for a more even dispersal of fluid throughout the cylindrical housings. However, it has been observed that operators of the apparatus 20 may leave lids 122 and 124 removed inadvertently. Thus, when the machine is turned on, rinse and wash fluid will not be properly contained within cleaning unit 24. To alleviate this problem, nozzles 164 and 180 may be installed in the cylindrical sides of prewash and wash stages 34 and 38.

As best seen in FIG. 3, apparatus 20 sits upon a pedestal 192 which is formed in a concrete floor F. Alternatively, apparatus 20 could rest on a flat floor. Pedestal 192 has formed within it a funnel shaped pan 194 which includes a center drainage aperture 196 that is coupled to an external drain pipe 198. Each of the pre-wash, wash, and rinse stages 34, 36 and 38 is vertically oriented and located above pan 194. Slots or drains may be placed in the floor of lower enclosure 42 to facilitate the drainage of leaking fluid into pan 194. In this manner, fluid escaping from the cleaning unit 24 is received by pan 194.

Referring to FIG. 3, the internal structure of wash fluid tank 174 is illustrated. Wash fluid tank 174 (which is substantially identical to rinse fluid tank 158) includes a water-tight housing 200, a conventional valve flush assembly 202, an inlet 204, a drain 206 and a removable lid 208. Periodically (such as once every twenty-four hours, for example), a human maintenance operator removes lid 208 and flushes flush assembly 202 to allow the wash fluid in tank 174 to drain into pan 194. For convenience, flush assembly 202 is connected to an external water source to allow the wash fluid tank 174 to be automatically filled (as in, for example, the same manner as a conventional flush-toilet) with soft tap water. The operator then adds a portion of detergent to the wash fluid tank 174. A similar flushing and filling operation is performed with rinse fluid tank 158, except without the step of adding detergent.

As can be seen, the foregoing apparatus 20 provides an effective ball cleaning operation. First, the balls are conveyed through pre-wash stage 34, where they are saturated with wash fluid. Then, the balls are conveyed through wash stage 36, where they are subject to the churning action of motor-driven screw conveyor 92, and the resulting foaming of wash fluid. The balls in wash stage 36 accumulate along the flights of screw conveyor 92. Thus, unlike pre-wash stage 34 (in which balls quickly traverse the spiral flights 82 of fix screw conveyor 80 under force of gravity), balls B in wash stage 36 have a longer residency time, which allows for a more thorough cleaning. This residency time may be lengthened as appropriate by slowing the speed at which the motor turns screw conveyor 92 or lengthening the wash stage cylindrical housing 86. Balls B then leave wash stage 36 and are conveyed through rinse stage 38, where they experience a relatively short residency time, and is explained in connection with pre-wash stage 34.

Because the wash fluid includes a detergent agent, it generates a foam under the churning action of motor-driven screw conveyor 92. This foaming action is not undesirable, and in fact is quite beneficial in thoroughly cleaning the balls. Foam accumulates at the lower end of wash stage 36 and backs up transfer chute 110. Because the balls are hollow and plastic, they float on the accumulated foam. As a result, the foam effectively clogs transfer chute 110 by preventing balls from sliding down transfer chute 110.

This clogging has proved to be a difficult problem to solve. Initially, it was believed that a suitable cleansing solution could be developed which would not generate enough foam to clog transfer chute 110, while still providing sufficient cleaning action. It was assumed, that increasing the flow of wash fluid into the cleaning unit 24 would only exacerbate the foam clogging problem. The inventors realized, however, that the problem could be solved by increasing the volume of wash fluid discharged into the pre-wash stage 34 relative to the fluid of the wash stage 36. The wash fluid discharged into the pre-wash stage 34 does not have the same propensity to foam as the wash fluid discharged in the wash stage 36 because the pre-wash screw conveyor 80 is not rotating. The pressure of the additional wash fluid provides greater propelling force on the balls to push them through the foam accumulating in the transfer chute 110 and into the wash ball stage inlet 88.

5. Pneumatic Conveyor System

As best seen in FIGS. 1 and 2, balls B emerging from outlet 102 of rinse stage 38 are conveyed by pneumatic conveyor 30 to clean ball hopper 26. Pneumatic conveyor 30 includes a pneumatic pump 210, a junction box 212 and first and second pipe portions 214 and 216. First pipe portion 214 conveys balls from outlet 102 to junction box 212. As balls fall from first pipe portion 214 into junction box 212, they are immediately forced into second pipe portion 216 by air pressure generated by pneumatic pump 210. This forced air propels the balls through second pipe portion 216 which extends vertically next to cleaning unit 24. Second pipe portion 216 carries ball B to clean ball hopper 26, which is preferably located in close proximity to soiled ball hopper 22. As seen in FIG. 1, clean ball hopper 26 includes an open-topped bin 218 and an inclined bottom 222 depending from bin 218. At the lowest point of inclined bottom 222, a hatch 224 is provided for dispensing clean balls from bin 218.

While the invention has been described with respect to preferred embodiments, it is to be understood that the invention is capable of numerous changes, rearrangements and modifications and that such changes, rearrangements and modifications are intended to be within the scope of the claims.

We claim:

1. An apparatus for washing balls in a fluid comprising:

(a) an elongated cylindrical housing suitable for receiving the fluid and having at least one open end, a first ball inlet, and a first ball outlet longitudinally spaced from said first ball inlet;

(b) a screw conveyor coaxially slidably disposed in said cylindrical housing to convey the balls from said ball inlet to said ball outlet, said screw conveyor being made of a plurality of sections, each section being mateably engagable with its adjacent sections;

(c) line means for coupling at least one pair of adjacent sections, said line means allowing said adjacent sections to be disengaged and separated from each other a distance sufficient so that one of said adjacent sections may be removed from said housing and tilted with respect to said housing's longitudinal axis while still coupled to the other adjacent sections by said line means.

2. The apparatus according to claim 1 wherein said elongated cylindrical housing is transparent.

3. The apparatus according to claim 1 further comprising:

a soiled ball hopper located above said elongated cylindrical housing and having a soiled ball outlet; and a ramp connecting said soiled ball outlet and said first ball inlet;

wherein said soiled ball hopper and said cylindrical housing are separated by a distance that is less than the length of said screw conveyor.

4. The apparatus according to claim 3 wherein said ramp includes a plurality of parallel elongated bars, said bars being spaced apart a distance less than the diameter of one of the balls, and wherein said ramp further includes a trough positioned below said bars for capturing balls which fall between said bars.

5. The apparatus according to claim 3 further comprising a fluid supply having a nozzle connected to the upper end of said housing, and a drain located near the lower end of said housing.

* * * * *